US006205759B1

(12) United States Patent
Kuroda

(10) Patent No.: US 6,205,759 B1
(45) Date of Patent: Mar. 27, 2001

(54) INDIVIDUAL-SPINDLE-DRIVE TYPE TEXTILE MACHINE

(75) Inventor: Keiji Kuroda, Shiga (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/292,923

(22) Filed: Apr. 16, 1999

(30) Foreign Application Priority Data

Aug. 24, 1998 (JP) ..... 10-237102

(51) Int. Cl.[7] ..... D01H 13/00

(52) U.S. Cl. ..... 57/100; 57/58.49; 57/1 R; 57/88

(58) Field of Search ..... 57/1 R, 58.49, 57/88, 136, 137, 174, 264, 265, 61, 78; 310/157, 80, 112, 114, 68 A, 67 R; 174/101, 48, 97

(56) References Cited

U.S. PATENT DOCUMENTS 4,888,452 * 12/1989 Krehl et al. ..... 174/101
5,224,331 * 7/1993 Stahlecker et al. ..... 57/100
5,396,757 * 3/1995 Kobayashi et al. ..... 57/100
5,906,092 * 5/1999 Hattori ..... 57/100

FOREIGN PATENT DOCUMENTS 64-68526 3/1989 (JP) .
64-68527 3/1989 (JP) .

* cited by examiner

*Primary Examiner*—Amy B. Vanatta
*Assistant Examiner*—Mary K. Fiore
(74) *Attorney, Agent, or Firm*—Armstrong, Westerman, Hattori, McLeland & Naughton

(57) ABSTRACT

To provide an individual-spindle-drive type textile machine capable of making a number of wires to the drive motor of each spindle unit compact even if the number of spindle units is large. Because the spindle units are arranged in two parallel arrays, one in front and one to the rear, maintenance work is greatly simplified. A wiring duct box, in which the common wiring line for each wiring is extended and routed, is disposed between the front-stage and rear-stage spindle unit group arrays, and is configured such that an electronic circuit board governing the rotation speed control of each motor is removably connected to the wiring line.

4 Claims, 4 Drawing Sheets

INDIVIDUAL-SPINDLE-DRIVE TYPE TEXTILE MACHINE

FIELD OF THE INVENTION

The present invention relates to an individual-spindle-drive type textile machine provided with a drive motor for each spindle unit so that the rotation speed of the drive motor, or the like, is individually controlled based on a command from a central control section.

BACKGROUND OF THE INVENTION

Due to advancements in inverter equipment and the integration of electronic control circuits, a precise control of a rotation speed of a motor and a yarn breakage detection can be processed by means of a small-sized electronic circuit board. In a textile machine in which a number of spindle units, such as 100 to 200 spindle units, are arranged in a line, therefore, an individual motor is provided for each spindle unit, and a control board is provided for each motor so that there is adopted a system for simultaneously or individually controlling the rotation speed of each spindle by a control signal from the central control section.

To provide a drive motor and its control board individually for each spindle unit and to drive and control the motor and board individually, it is necessary to provide a power supply line and a control signal line to the motor and board, respectively. Therefore, as the number of spindle units increases, the number of wires for each motor or its control board also increases. As a result, the wiring lines are extremely complicated and difficult to service or adjust.

For example, if a yarn breakage or a fault occurs with a specific spindle unit, an operator must restore the spindle unit on-site. In the case in which a greater number of spindle units is used, and each spindle unit is arranged in a line in two spacedly parallel arrays, one in front of the unit and the other in the rear of the unit, the operator must walk a long distance from the front array to the rear array, thus hampering maintenance efficiency. In addition, work efficiency is also lowered by the fact that when these control boards are mounted, the operator must mount them while moving from the front array to the rear array.

SUMMARY OF THE INVENTION

To overcome the above problems, the present invention provides an individual-spindle-drive type textile machine wherein a spindle unit group array in which a plurality of spindle units provided with respective specific drive motors for each spindle unit are laterally arranged in a line are disposed in parallel in at least two arrays, one in front and one in the rear, characterized in that a oblong wiring duct box is disposed along the spindle unit group array between the front and rear spindle unit group arrays, the wire line for the drive motor is extended and routed longitudinally on one face inside the duct box, and a plurality of electronic boards for controlling the motors are detachably connected to the wire line in the same direction.

DETAILED DESCRIPTION OF THE PREFERRED EMBODIMENTS

Hereinafter, an embodiment of an individual-spindle-drive type textile machine according to the present invention will be described by showing an example of an individual-spindle-drive type multiple twister.

Figure 1:
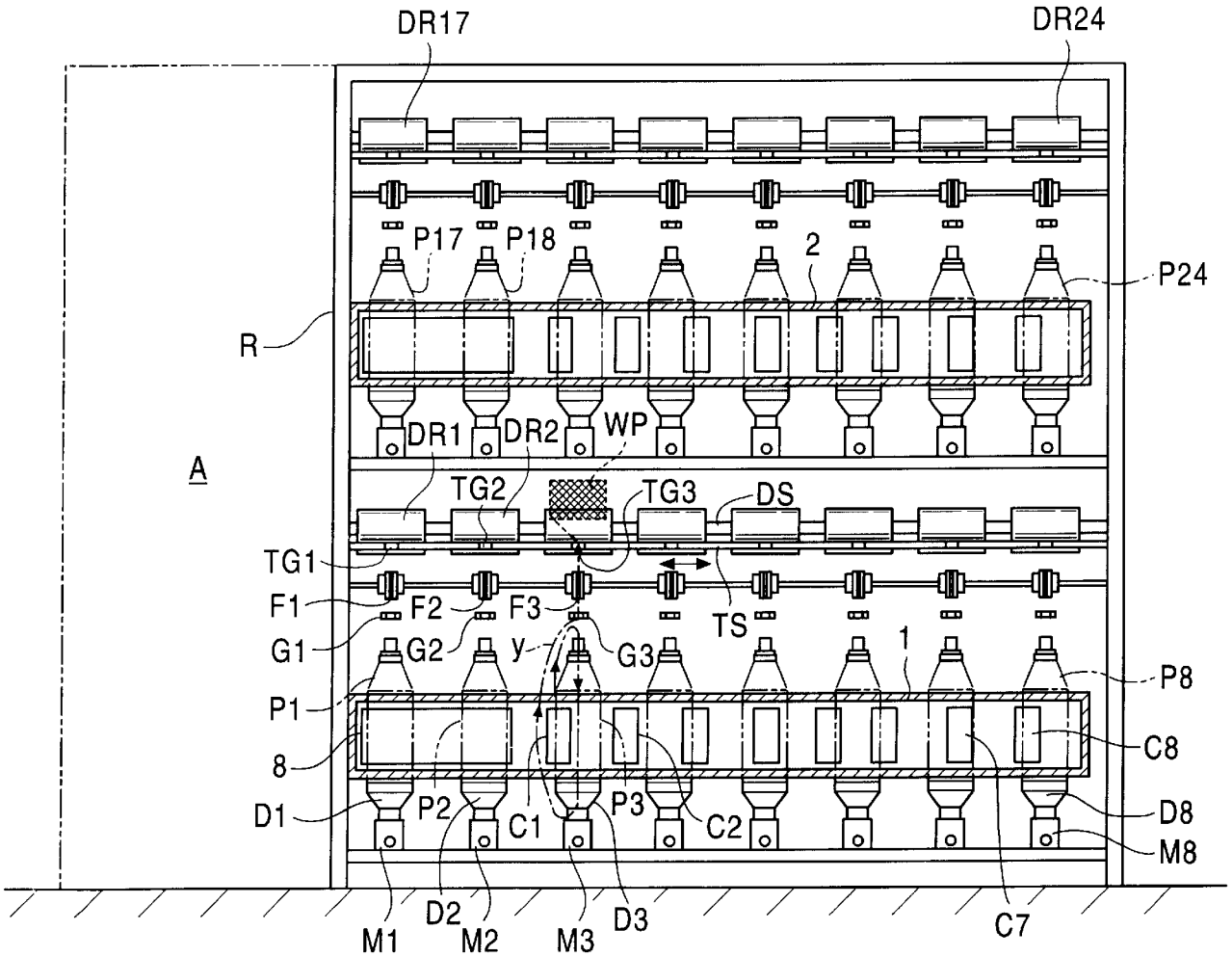
FIG. 1 is a front view of an example where the present invention is embodied in a multiple twister in which a number of spindle units are arranged in a line to the front and rear array.
Figure 2:
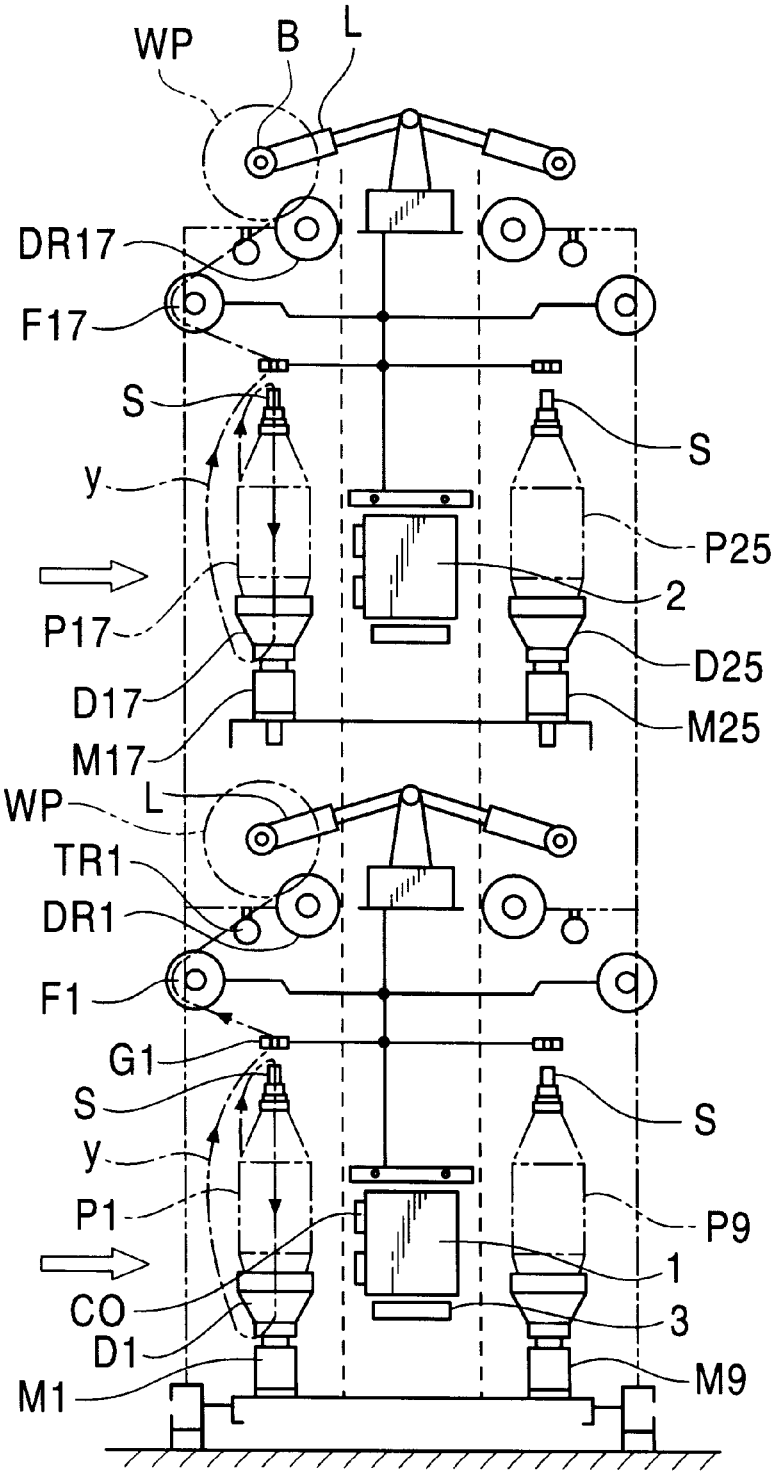
FIG. 2 is a side view of the multiple twister of FIG. 1 in which a machine frame or the like is partially omitted.
Figure 3:
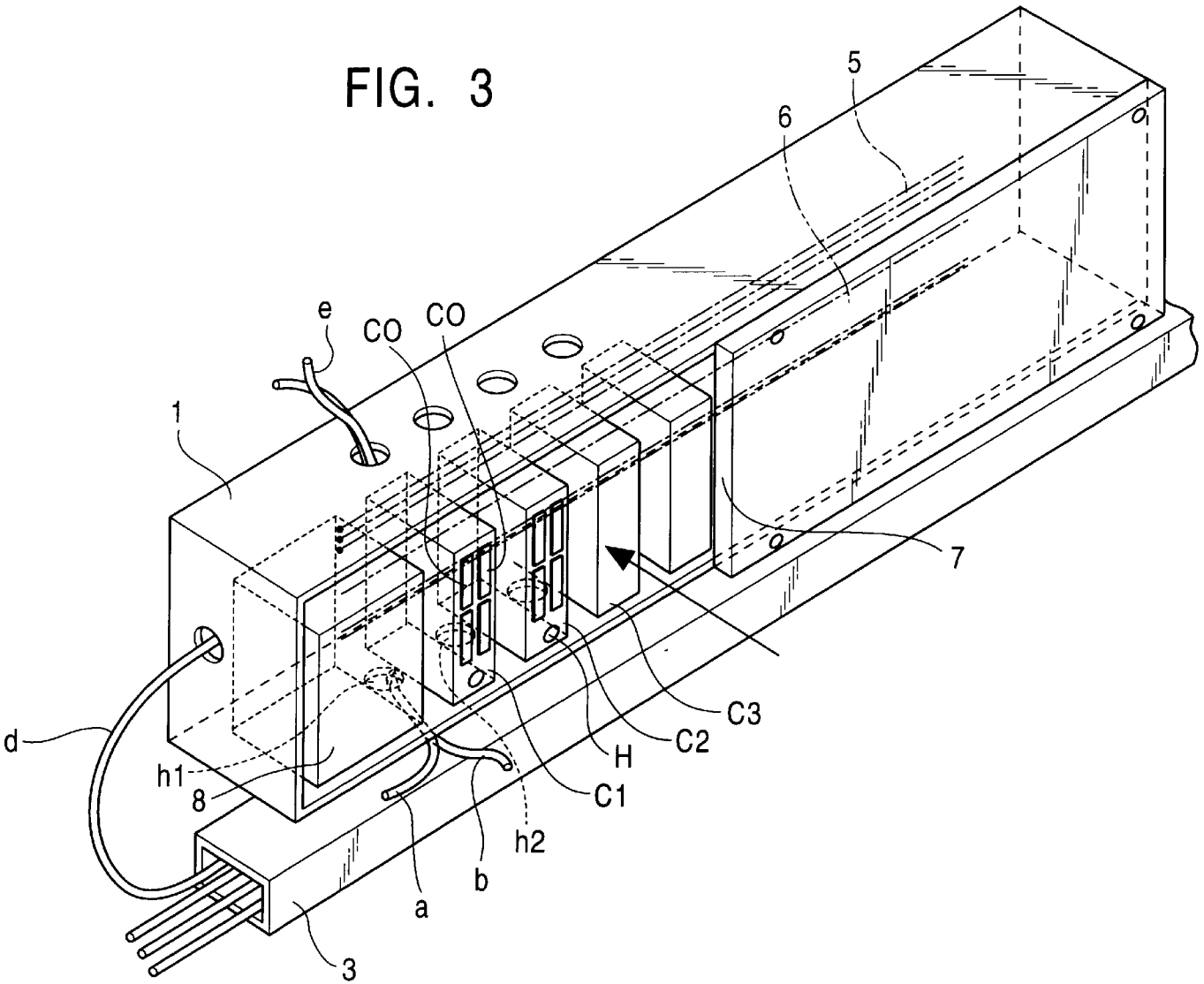
FIG. 3 is a perspective view of a wiring duct box.
Figure 4:
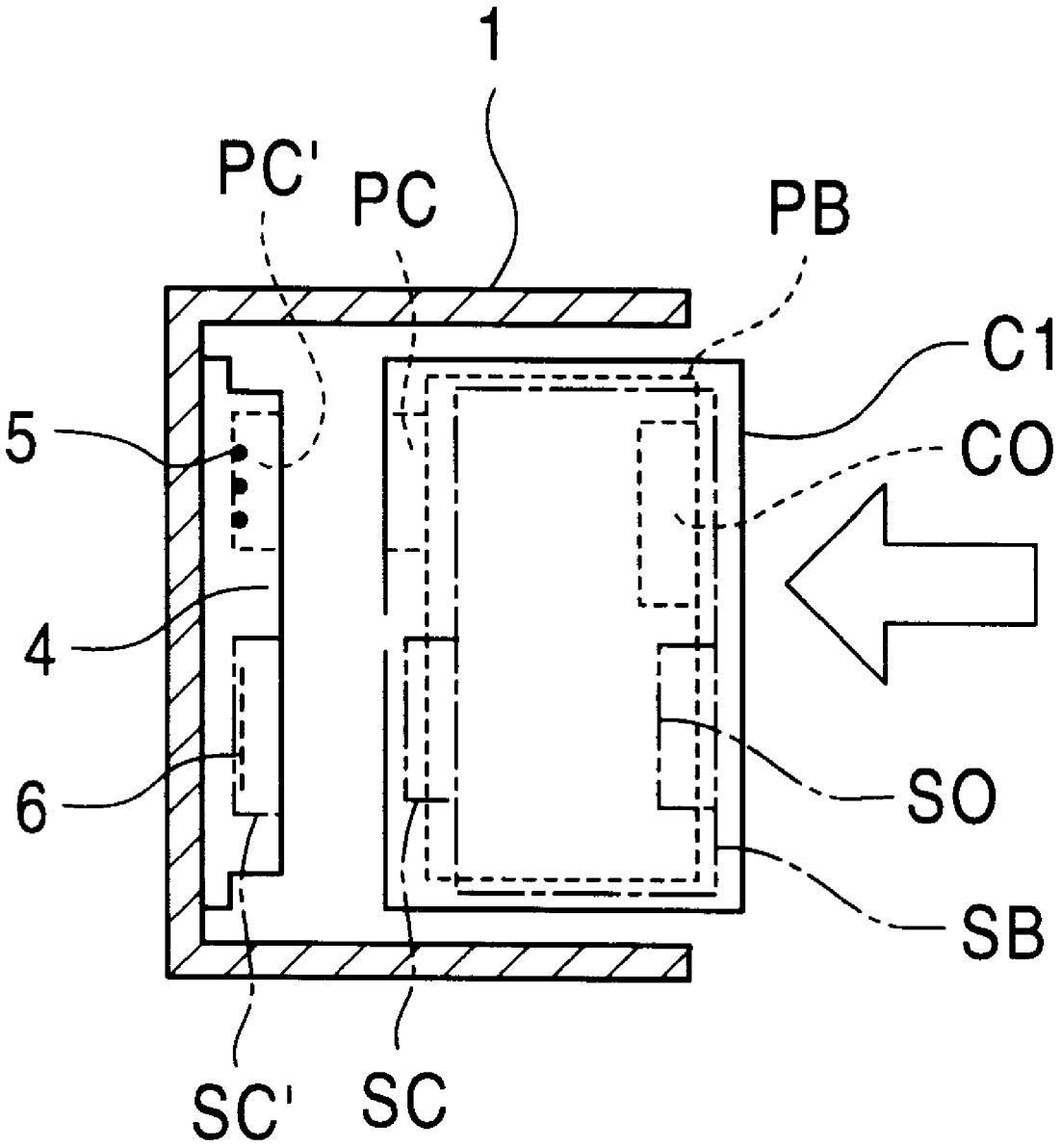
FIG. 4 is a sectional side view of the wiring duct box.

FIG. 1 is a front view of an individual-spindle-drive type multiple twister embodying the present invention. FIG. 2 is a side view of the multiple twister. FIG. 3 is a perspective view for illustrating an internal configuration of a wiring duct box. FIG. 4 is a sectional side view of the wiring duct box.

FIGS. 1 and 2 show the arragemet relationship between each spindle unit array of the twister and essential portions of the present invention, and M1, M2, M3 . . . M8 are variable speed motors provided in each spindle unit for driving each disk. D1, D2, D3 . . . D8 are rotary disks for twisting a yarn unwound from a yarn supply package, and the rotary disks are directly connected to the output shaft of each motor and are rotated.

P1, P2, P3 . . . are yarn supply packages detachably mounted to the center shaft of the rotary disk, and the package itself is held stationary by appropriate braking means (not shown in the drawings) irrespective of rotation of the rotary disk. G1, G2, G3 . . . are yarn guides for guiding a twisted yarn y discharged from the rotary disk to a winding device. F1, F2, F3 . . . are feed rollers for feeding the twisted yarn to the winding unit while adjusting its tension. TG1, TG2, TG3 . . . are traverse guides installed for each spindle unit on one traverse shaft TS, and the traverse shaft TS moves reciprocally in the horizontal direction (shown by an arrow) in FIG. 1 by means of a traverse driving device installed in an operation control section A indicated by a chain double-dashed line on the left side of a machine frame R.

DR1, DR2, DR3 . . . are drums for driving winding packages WP by surface contact, and the drums for all spindle units are rotated simultaneously by means of a single driving shaft DS. The driving shaft DS is driven by means of a driving source in the operation control section A on the left side of the machine base of FIG. 1. In addition, the yarn is configured so as to be wound on a paper tube B held on a cradle L in the same way as in a conventional twister.

In the above configuration of the twister, the yarn twisting operation of each spindle unit is performed as follows.

The yarn y unwound from the yarn supply package P1 is guided downward from the tip of a hollow spindle S holding a package holder through the inside of the spindle, and is discharged downward from the rotary disk D1 that rotates at a high speed. The discharged yarn y is unwound from the yarn supply package P1 while it is swiveled, therefore, one twist is imparted at this stage. Further, the yarn y discharged downward from the disk D1 is guided to the feed roller F1 through the yarn guide G1 while the outer circumference of the yarn supply package P1 is swiveled by the disk rotation. At this stage, the yarn y discharged by the rotary disk D1 is swung around the yarn supply package P1. As a result, one more twist is imparted, and the double-twisted yarn is fed to a traverse device by means of the feed roller F1. The twisted yarn is adjusted to an appropriate tension by means of the feed roller F1 and is wound around the winding package WP, which is driven by the drum D1.

As is obvious from FIG. 1, in this embodiment of yarn twisting spindle unit which includes the drive motor M1, the rotary disk D1, the yarn supply package P1, the yarn guide G1, the feed roller F1 and the winding driving drum DR1, all eight spindle units up to M8, D8 and P8 are laterally arranged in a line, and at the same time, as is obvious from FIG. 2, in addition to these spindle units, eight pairs of spindle units from P9 are placed to the rear, thus configuring 16 spindle units constituting one span. Further, as is obvious from FIGS. 1 and 2, these spindle units are installed at the upper stage portion of the machine frame in the same number. That is, a total of 32 spindle units are installed on the single machine frame R, and all of these spindle units are controlled by the single operation control section A. In actual twister, a number of these frames are arranged laterally, and in some machines, over 200 spindle units are provided.

The quality of the twisted yarn wound in each spindle unit varies depending on a rotation speed of the rotary disk, and to maintain the quality of the twisted yarn on each winding package, it is necessary to precisely control the rotation speed of the drive motor of each spindle unit to a predetermined value on the basis of an instruction signal from the central operation control section. In addition, the disk rotation speed of each spindle unit is transmitted from the input side of each motor to the central operation control section. If yarn breakage or some other trouble occurs with any of the spindle units, as a matter of course, the tension of the yarn is lowered, thereby causing the motor load to vary, and this variation is immediately transmitted to the central operation control section via a motor control signal line. Each of these motors is controlled by means of electronic circuit elements, and these electronic circuit elements are mounted on one or two control system boards for each spindle unit. Of course, power system circuit boards for supplying power to each motor (for inverter control and pulse control), respectively, are required for each spindle unit.

In general, these power system circuit boards and control system circuit boards are housed in one box for each spindle unit, and the box is installed on the lower front face of that spindle unit. Alternatively, the boards are housed in the wiring duct box intensively integrated for each span, and the wiring duct box is installed in front of each span. That is, in the opposing spindle unit groups disposed in the front and rear arrays, these boards are disposed in front for the front spindle unit array, and these boards are disposed behind the front spindle unit array for the rear spindle unit array (in front of the spindle units in the rear array).

In any case, if a large number of spindle units is provided, the control system wiring between each board and the central control section, and the power system wiring from the power supply source are extremely large in number, and causing congestion. Therefore, for maintenance, and in particular, making individual settings and adjustments for each spindle unit, the operator must walk from the front array to the rear array, and work efficiency is poor.

In this embodiment of the present invention, to solve this problem, common wiring duct boxes 1 and 2 are disposed per each span in between the front array spindle unit group and the rear array spindle unit group, and the power system wiring line and the control system wiring line are extended and routed in common so that it is possible to easily mount and remove or manipulate the boards of the paired front array and rear array spindle units for the wiring line from one direction. The wiring duct boxes 1 and 2 are disposed at the height of the yarn supply package between the front array spindle unit group and the rear array spindle unit group, respectively, and a required part of the yarn supply package is removed from a center shaft, thereby facilitating maintenance work.

Hereinafter, an embodiment of the wiring duct box 1 will be described with reference to FIGS. 3 and 4. The duct box 1 has the same structure as the duct box 2.

In FIG. 3, 4 is a base member (FIG. 4) mounted longitudinally on the inner vertical face of the rear face of the duct box 1, and a power system wiring line 5 (for example, 290 volts) is extended and routed at the upper part of the base member 4 and a control system wiring line 6 (for example, 12 volts) is extended and routed at the lower part of the base member 4. C1, C2 . . . are motor control cases in which two boards, i.e., a control electronic circuit board that governs signal process of the control of the motor's rotation speed and so on, and a circuit board that governs the power supply to the motor are housed in one group or one set. C1 is a control case for two boards for motor M1 and motor M9 which is provided in the rear array (for power and control). C2 is a case for motor M2 and motor M10 which is provided in the rear array. C3 is a case for the motor M3 and M1. Therefore, in a twister in which a total of 16 spindle units, (8 front spindle units and 8 rear spindle units) are provided over one span, a total of eight motor control cases are inserted into and mounted on the duct box 1.

As shown in FIG. 4, a group of two boards to be housed in the case is provided so as to be orthogonal to the mount face of the duct box 1, that is, a control connector SC at the far end of a rotation speed control electronic circuit board SB and a power connector PC at the far end of the power circuit board PB. On the other hand, in the area where each board of the power system wiring line 5 is extended and routed to the base member of the inner rear face of the wiring duct box 1, a power connector PC' . . . of the base member side is provided, and likewise, in the area where each board of the control system wiring line 6 is inserted and mounted, a control connector SC' . . . of the base member side is provided. Thereby, merely by inserting and mounting the control case C1 through the front of the duct box in the arrow direction, the control connector SC of the board side is connected to the connector SC' of the base member side, and the power connector PC of the board side is connected to the connector PC' of the base member side, and the connection between each of the power line and the control system signal line, and each of the respective electronic circuit boards is completed. The output from the circuit board is wired from an opening h1 at the bottom of the duct box to each motor via an output connector C0 disposed in front of the board.

In this embodiment, the electronic circuits for governing power supply to the motors M1 and M9 are simultaneously mounted to one power circuit board PB, and the electronic circuit outputs are supplied from the output connector C0 (separately provided to the right and left, as exemplified in FIG. 3) to the motors M1 and M9 through the opening h1 via respective wires a and b. Likewise, a set of the electronic circuit board for the power system and the electronic circuit board for the control system for the motor M2 and the motor M10 of the spindle unit provided in the rear array thereof is housed in the neighboring control case C2. As is true for the foregoing, signals from the power line 5 and the control signal line 6 are received via the respective connectors, and a signal for controlling the rotation speed of each motor is supplied from the output connector C0 to the motors M2 and M10 through a second opening h2 formed at the bottom of the duct box.

In the example just described, although the control circuits of the two motors for the front and rear arrays are mounted on one control system board, the control circuits for the neighboring left and right motors (for example, M1 and M2) may be mounted on the same board, and in addition, three or four motor control circuits can be mounted on one board by increasing the processing capacity of the central calculating unit or mounting density.

In FIG. 3, H is an alarm provided on the front face of the case for alerting operators of a fault or the like.

To facilitate explanation, in FIG. 4, the two boards housed in one control case C1, that is, the power system board PB and the control system board SB are shown slightly displaced, however, these boards are in fact disposed with each other being in completely parallel, and are designed so that signal exchange is performed through an appropriate lead wire.

8 is a relay device for signal that temporarily relays a signal from a central operation control device (not shown in the drawings) and transmits the signal to each control case in the duct box 1 via the control system wiring line.

In addition, although a detailed description is omitted, these electronic circuits not only govern motor rotation speed of the respective associated motor of the spindle unit, but also by detecting the load change of the motor (for example, in case the yarn breakage occurs), transmit signals to the central operation control device via the relay device 8, and further, in the case where a solenoid valve for threading yarn (not shown in the drawings) or a warning lamp or the like is mounted onto each spindle unit, a function for sending an operational signal thereto is provided (in FIG. 3, e is a signal line for that purpose).

Furthermore, 7 is a cover for covering the front opening of the wiring duct box 1, and the cover 7 is made of a transparent material so that a warning lamp in the control case can be easily visible, and the cover 7 is easily removed using a screwdriver (only the right half of the cover is shown in the FIG. 3.)

In FIG. 3, 3 is a power line duct for supplying power from the power source to the relay device of each span, and the power line duct 3 is common to all spans. FIG. 3 shows an example where a transmission line d for one span (16 spindle units) is connected to the power wiring line 5 through the relay device 8.

An example has been described wherein the power board and control board of the drive motors M1 to M16 for 16 spindle units (one span) in the lower front and rear array of FIG. 1 are housed in eight control cases which are mounted inside the wiring duct box 1, so that they can be manipulated easily, in the arrow direction denoted in FIGS. 3 and 4. Likewise, the boards of the motors for 16 spindle units at the upper stage are housed integrally in the duct box 2.

In this way, even if the number of spindle units is increased, the wiring structure can be made extremely compact, and even if two spindle unit arrays, one front and one rear, are provided, all of the boards can be mounted or removed and adjusted from one direction (the direction shown by the arrows in FIGS. 3 and 4), thus greatly simplifying maintenance operations. All of the boards are detachably mounted on the vertical board mounting face of the duct boxes 1 and 2, and in addition, each board is so provided as to be orthogonal to the board mounting faces of the duct boxes 1 and 2. Therefore, the duct boxes 1 and 2 can be made compact, and the board can be easily detachably mounted on the vertical face towards the operator, and further, the mounting face of each board is easily visible, and performance checks can be easily conducted using an LED or the like. Even if an arbitrary control board or control case is removed, the power system and control system operations of other spindle units continue to operate normally.

In this embodiment, each electronic circuit board comprises a pair of power and control circuit boards, thus making it possible to completely prevent malfunctions due to noise or mutual interference affected to the control electronic circuit board by the power electronic circuit board. In addition, the boards are parallel and one upon another to each other, thereby making it possible to effectively utilize the space between the front and rear spindle unit arrays and achieve a compact design for the entire textile machine.

In the above mentioned embodiment, as an example of an individual-spindle-drive type textile machine, an example of a multiple twister has been described wherein the exclusive drive motor for the each spindle unit is a drive motor of a rotary disk for twisting the yarn of each spindle unit. In a draw texturing false twister, an air spinning machine or a winder, a dust box system of the present invention would provide similar effects for the control electronic circuit that governs the respective actuation of each spindle unit. Specifically, in a multiple twister, it is necessary to control the rotation speed of the rotary disk with high precision so as to match the operating environment of each spindle unit and ensure that the quality of the twisted yarn for each spindle unit is uniform, and the wiring needed for that purpose would normally be diverse and complicated, but the duct box system of the present invention can solve these problems.

In an individual-spindle-drive type textile machine according to the present invention, even if the number of spindle units is extremely high, certain aspects of equipment engineering and production and field maintenance and management are greatly improved, and the advantages of the invention include compact wiring, easy wiring work, reduced wiring costs, and improved efficiency when performing electrical maintenance work for each spindle unit.

What is claimed is:

1. An individual-spindle-drive textile machine including a spindle unit group array, in which a plurality of spindle units, each being provide with an exclusive drive motor, are laterally arranged in lines, said units being disposed in at least two parallel arrays, each including one unit in a front line and one unit in a rear line, said textile machine comprising:

an oblong wiring duct box disposed along the spindle unit group arrays between the front and the rear lines of said spindle units, wherein a wiring line for said drive motors is extended and routed longitudinally on one face inside the duct box, and a plurality of substantially parallelly arranged electronic circuit boards for controlling the respective drive motors are disposed within the box perpendicular to said wiring line to be detachably connected to the wiring line.

2. An individual-spindle-drive textile machine including a spindle unit group array in which a plurality of spindle units provided with respective exclusive drive motors for each spindle unit are laterally arranged in a line, is disposed in parallel in at least two arrays, one in front and one in the rear, said textile machine comprising:

an oblong wiring duct box is disposed along the spindle unit group arrays between a front spindle unit group array and a rear spindle unit group array, wherein a wiring line for said drive motor is extended and routed longitudinally on one face inside the duct box, and a plurality of electronic circuit boards for controlling the drive motors are detachably connected to the wiring line in the same direction, and wherein the electronic circuit board for controlling the drive motor is an electronic circuit board that includes a function for controlling at least two motors simultaneously or individually on a single board.

3. An individual-spindle-drive textile machine including a spindle unit group array in which a plurality of spindle units provided with respective exclusive drive motors for each spindle unit are laterally arranged in a line, is disposed in parallel in at least two arrays, one in front and one in the rear, said textile machine comprising:

an oblong wiring duct box is disposed along the spindle unit group arrays between a front spindle unit group array and a rear spindle unit group array, wherein a wiring line for said drive motor is extended and routed longitudinally on one face inside the duct box, and a plurality of electronic circuit boards for controlling the drive motors are detachably connected to the wiring line in the same direction, and wherein said wiring line for drive motors is separated into a power system wiring line and a control system wiring line, and each electronic circuit board comprises a power electronic circuit board and a control electronic circuit board to be connected to each of said two wiring lines.

4. An individual-spindle-drive textile machine as in claim 3, wherein said power electronic circuit board and control electronic circuit board are housed in one control case so that these boards are integrally mounted to and removed from the wiring duct box.

* * * * *